United States Patent [19]

Vought et al.

[11] Patent Number: 4,743,128

[45] Date of Patent: May 10, 1988

[54] PRINT HAMMER SOLENOID CONDITIONED SINGLE SOLENOID RIBBON AND TAPE FEED SYSTEM

[75] Inventors: Kenneth D. Vought; Hans W. Mueller, both of Cortland, N.Y.

[73] Assignee: Smith Corona Corporation, Cortland, N.Y.

[21] Appl. No.: 940,314

[22] Filed: Dec. 10, 1986

[51] Int. Cl.[4] ..... B41J 23/34; B41J 29/36

[52] U.S. Cl. ..... 400/184; 400/185; 400/212; 400/214; 400/225; 400/697.1

[58] Field of Search ..... 400/185, 187, 211, 212, 400/214, 215, 223, 225, 236, 236.1, 236.2, 697, 697.1, 184

[56] References Cited

U.S. PATENT DOCUMENTS 4,390,293 6/1983 Gubau et al. ..... 400/697.1
4,407,594 10/1983 Link ..... 400/697.1
4,411,542 10/1983 Wenderoth ..... 400/212
4,609,297 9/1986 Hubner et al. ..... 400/187

FOREIGN PATENT DOCUMENTS 133090 8/1982 Japan ..... 400/212

*Primary Examiner*—David Wiecking
*Attorney, Agent, or Firm*—Kenneth W. Greb

[57] ABSTRACT

A single solenoid is connected to a ribbon feed mechanism which is selectively operable either to feed a print ribbon or to lift and feed an error correction tape. A print hammer solenoid is operable to condition the ribbon feed mechanism either for feeding the print ribbon or lifting and feeding the error correction tape. To feed the print ribbon, an electronic circuit energizes the print hammer solenoid before energizing the ribbon feed solenoid in response to depressing a character key. To lift and feed the error correction tape, the electronic circuit energizes the print hammer solenoid after energizing the ribbon feed solenoid in response to depressing a correction key.

8 Claims, 4 Drawing Sheets

PRINT HAMMER SOLENOID CONDITIONED SINGLE SOLENOID RIBBON AND TAPE FEED SYSTEM

BACKGROUND OF THE INVENTION

1. Field of the Invention

This invention relates to an error correction tape and a print ribbon feed system for printing machines such as typewriters and like machines and, more particularly, it relates to a single ribbon feed solenoid connected to a ribbon feed mechanism conditioned by a print hammer solenoid for feeding a print ribbon or lifting and feeding an error correction tape.

2. Prior Art

Known print ribbon and error correction tape feed systems have ribbon feed mechanisms operable to lift and feed a print ribbon or an error correction tape by reversing the direction of rotation of a stepper motor. These ribbon feed systems are disclosed in U.S. Pat. No. 4,606,662 issued on Aug. 19, 1986, invented by Steven R. Komplin and U.S. Pat. No. 4,609,297 issued on Sept. 2, 1986, invented by Manfred Hubner and Wilfried Rettke.

A known print ribbon feed mechanism operated by a print hammer solenoid is disclosed in U.S. Pat. No. 4,443,124 issued on Apr. 17, 1984 and invented by Toshiaki Ozawa.

None of these patents teach a print hammer solenoid being operable to condition a single solenoid actuated ribbon feed mechanism either to feed a print ribbon or alternately to lift and feed an error correction tape.

SUMMARY OF THE INVENTION

In the illustrated embodiment of the present invention, there is shown a ribbon feed mechanism for an electronic typewriter actuated by a single solenoid and conditioned by a print hammer solenoid either for feeding a print ribbon or for lifting and feeding an error correction tape. To feed the print ribbon, an electronic circuit energizes the print hammer solenoid before energizing the ribbon feed solenoid in response to depressing a character key. To lift and feed the error correction tape, the electronic circuit energizes the print hammer solenoid after energizing the ribbon feed solenoid in response to depressing a correction key.

The print ribbon remains in a print position during printing operations. Therefore, no provision is needed in the ribbon feed mechanism to lift and lower the print ribbon relative to the printing line.

Accordingly, the object of this invention is to provide an economical and efficient ribbon feed mechanism. Only a single solenoid is used for the driving force. A print hammer solenoid is used for a second purpose which is to condition the ribbon feed mechanism either to feed the print ribbon or to lift and feed the error correction ribbon.

Other objects, features and advantages of the invention will become more apparent from the following description, including appended claims and accompanying drawing.

DETAILED DESCRIPTION OF THE INVENTION

Figure 1:
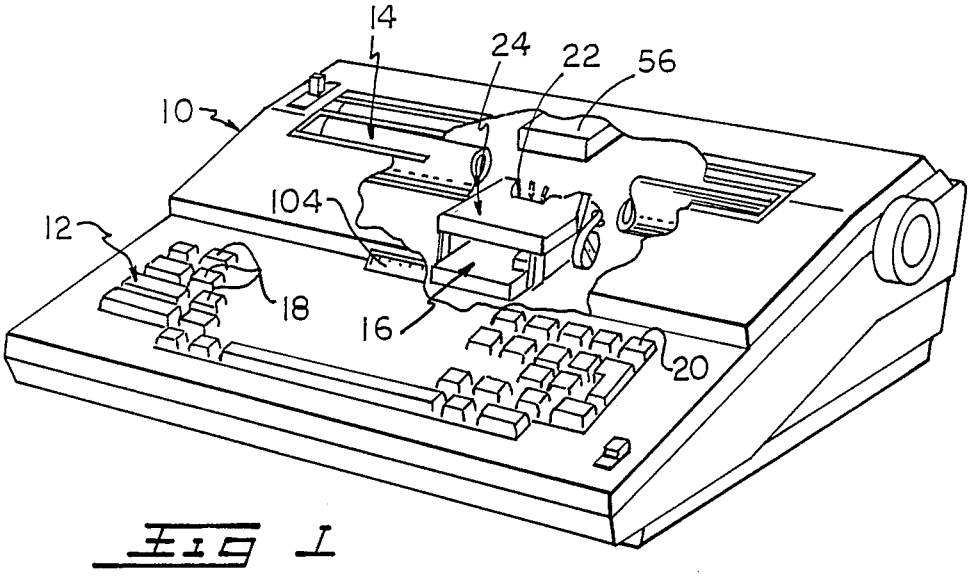
FIG. 1 is a perspective view of an electronic typewriter including a ribbon feed system made in accordance with the present invention.
Figure 3:
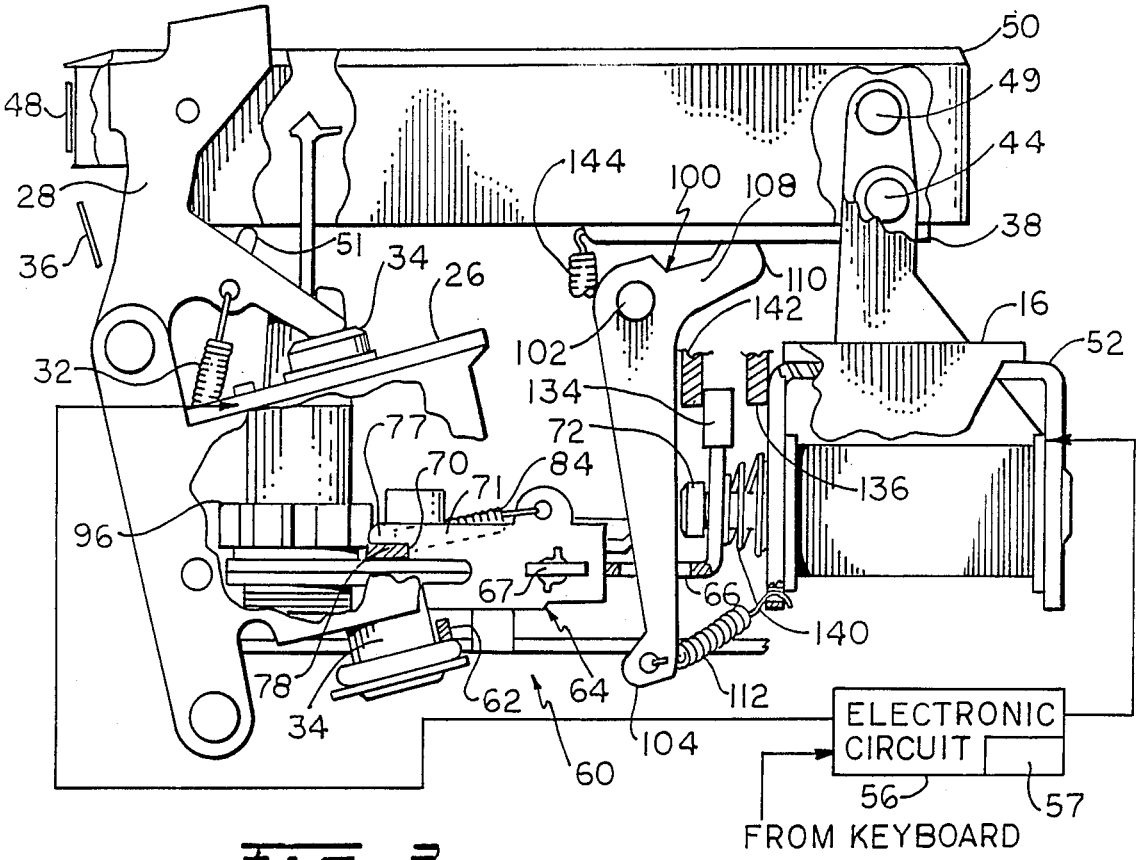
FIG. 3 is a left side view showing the ribbon feed mechanism in an initial condition.

An electronic error correcting typewriter 10 comprising the present invention is shown in FIG. 1. Generally, the typewriter 10 comprises a keyboard 12, a platen 14 and a carrier 16. The keyboard 12 includes character keys 18 and an error correction key 20. A printwheel 22 and a ribbon feed system 24 are mounted on the carrier 16.

Figure 2:
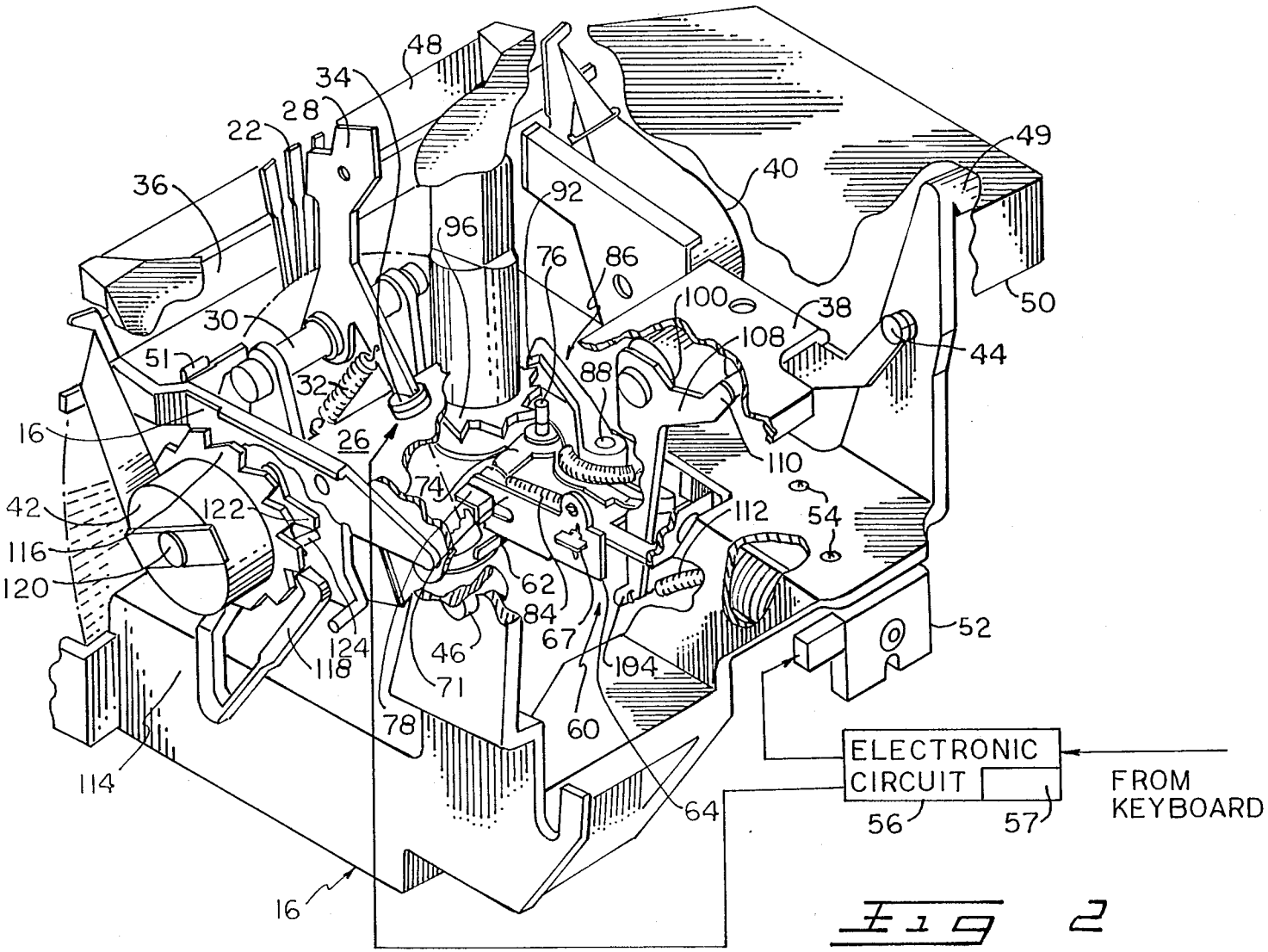
FIG. 2 is a perspective view of the ribbon feed mechaism including a ribbon feed solenoid and a print hammer solenoid.
Figure 5:
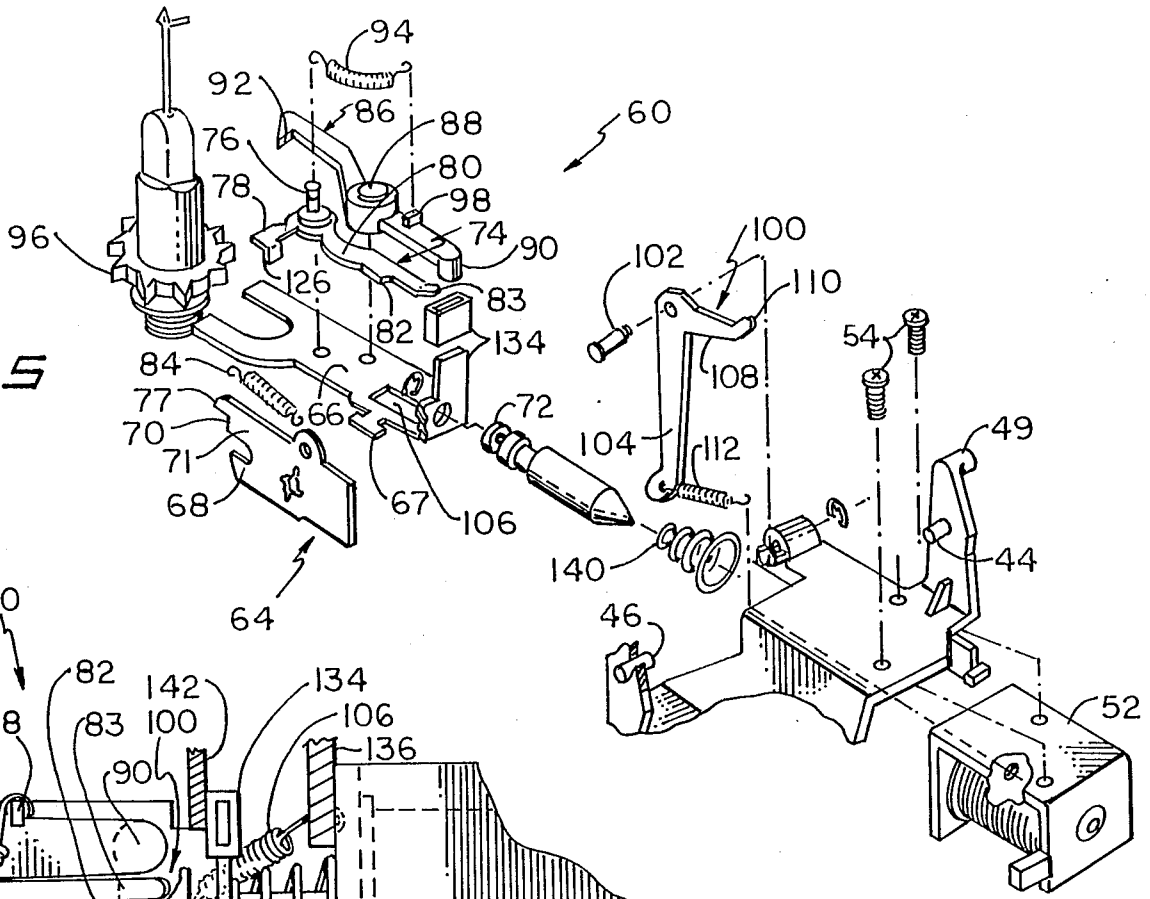
FIG. 5 is an exploded perspective view of a portion of the ribbon feed mechanism of FIG. 3.

Referring now to FIG. 2, a print hammer solenoid 26 is mounted on the carrier 16. A print hammer 28 is pivotally mounted on the carrier 16 by a shaft 30. A spring 32 biases the print hammer 28 against a plunger 34 of the print hammer solenoid 26. An error correction tape 36 is mounted on a platform 38 by a supply spool 40 on the right side of the print hammer 28 and by a take-up spool 42 on the left side of the print hammer 28. The platform 38 is pivotally mounted on the carrier 16 at pivot pins 44 and 46. A print ribbon 48 is supported in a ribbon cartridge 50 which is mounted on the carrier 16 on two pivot posts 49 (only one shown). The ribbon cartridge 50 also rests downward by gravity against a down stop 51 on the platform 38 near the printwheel 22. A ribbon feed solenoid 52 is mounted on the carrier 16 by screws 54. An electronic circuit 56 is mounted in the typewriter 10. The electric circuit 56 receives signals from the keyboard 12 for energizing the print hammer solenoid 26 and the ribbon feed solenoid 52. A circuit means 57 within the electronic circuit 56 is operable to energize the print hammer solenoid 26 before energizing the ribbon feed solenoid 52 in response to depressing a character key 18. The circuit means 57 is also operable to energize the print hammer solenoid 26 after energizing the ribbon feed solenoid 52 in response to depressing the correction key 20.

A ribbon feed mechanism 60 is shown in detail in FIGS. 3–7. An actuator 62 is connected to the lower end of the plunger 34 of the print hammer solenoid 26 for movement therewith. A latch 64 is pivotally mounted on a plate 66 by a tab 67. The latch 64 has a first finger 68 normally in the path of movement of the actuator 62. The latch 64 also has a step shaped abutment 70 located on a second finger 71. The plate 66 is connected to a plunger 72 of the ribbon feed solenoid 52 for movement therewith. A bellcrank 74 is pivotally mounted on the plate 66 by a post 76. The bellcrank 74 has a first arm 78 engageable with the abutment 70 of the latch 64. The bellcrank 74 has a second arm 80 with a step shaped abutment 82 and a free end 83. A spring 84 is connected to the latch 64 and to the first arm 78 of the bellcrank 74. The spring 84 biases the bellcrank 64 counterclockwise (FIG. 4) about the post 76 to bias the first arm 78 against the abutment 70 of the latch 64. The spring 84 also biases the latch 64 counterclockwise (FIG. 3) about the tab 67 to bias a free end 77 of the second finger 71 against the first arm 78 of the bellcrank 74.

A feed pawl 86 is pivotally mounted on the plate 66 by a post 88. The feed pawl 86 has an abutment 90 at one free end and has a tooth 92 at the opposite free end. A spring 94 is connected to the feed pawl 86 at a spring anchor 98 and to the post 76. The spring 94 biases the feed pawl 86 clockwise about the post 88 to bias the abutment 90 against the free end 83 of the second arm 80 of the bellcrank 74. The tension of the spring 94 is less than the tension of the spring 84. Therefore, the spring 94 does not change the position of the bellcrank 74 established by the spring 84. A toothed ratchet 96 is pivotally mounted on the carrier 16 adjacent to the feed pawl 86. Rotation of the ratchet 96 feeds the print ribbon 58. A bellcrank 100 is pivotally mounted on the carrier 16 by a pin 102. The bellcrank 100 has a first arm 104 extending downward through an aperature 106 in the plate 66. The bellcrank 100 has a second arm 108 extending horizontally with an abutment 110 at the free end. A spring 112 is connected to the first arm 104 of the bellcrank 100 and to the solenoid 52. The spring 112 biases the bellcrank 100 counterclockwise (FIG. 5) about the pin 102 to bias the first arm 104 against the plate 66 and in the path of the abutment 82 on the second arm 80 of the bellcrank 74.

Referring to FIG. 2, an error correction tape feed mechanism 114 is mounted on the platform 38 on the left side of the print hammer 28. The feed mechanism 114 has a toothed ratchet 116 integrally formed with the take-up spool 42. A feed pawl 118 is pivotally mounted on a post 120. The post 120 is mounted on the platform 38 and has a common axis with the take-up spool 42. A U-shaped fork 122 integrally formed with the feed pawl 118 straddles a post 124 integrally formed on the carrier 16.

FEEDING THE PRINT RIBBON

The print ribbon 48 remains in the print position during printing operations by the ribbon cassette 50 resting against the down stop 51 of the platform 38. Therefore, no provisions are made in the ribbon feed system to lift and lower the print ribbon 48 relative to the print point for printing operations.

Figure 6:
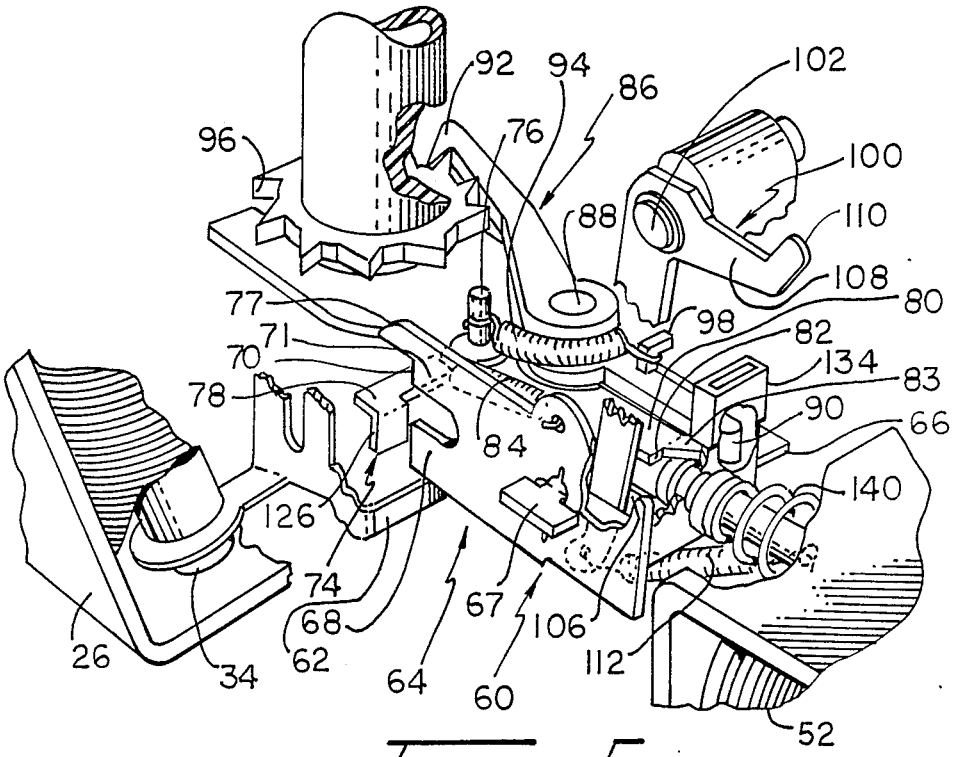
FIG. 6 is a perspective view showing the portion of the ribbon feed mechanism of FIG. 3 in condition to feed the print ribbon.

When a character key 18 is depressed, the circuit means 57 is operable to energize the print hammer solenoid 26 before energizing the ribbon feed solenoid 52. A lapse of time before energizing the ribbon feed solenoid 52 is sufficient to allow the plunger 34 to travel upward substantially its full stroke. Referring to FIG. 6, the actuator 62 contacts and pivots the latch 64 clockwise about the tab 67. The abutment 70 of the latch 64 is pivoted away from the first arm 78 of the bellcrank 74. The spring 84 pivots the bellcrank 74 counterclockwise about the post 76. The free end 83 on the second arm 80 of the bellcrank 74 abutting against the abutment 90 pivots the feed pawl 86 counterclockwise about the post 88. The tooth 92 of the feed pawl 86 engages the toothed ratchet 96. When the bellcrank 74 is pivoted counterclockwise by the spring 84, the abutment 82 on the second arm 80 of the bellcrank 74 pivots away from the first arm 104 of the bellcrank 100.

The ribbon feed solenoid 52 is energized by the circuit means 57 after the tooth 92 is engaged with the toothed ratchet 96. The plunger 72 of the ribbon feed solenoid 52 is moved from a rest position (FIG. 4) to an actuated position (FIG. 6). The plate 66 drives the feed pawl 86 to the right causing the tooth 92 to rotate the toothed ratchet 96 for feeding the print ribbon 48 one increment. The bellcrank 74 being mounted on the plate 66 also moves to the right. The bellcrank 74 remains pivoted by the spring 84 during the movement to the right. Therefore, the abutment 82 on the second arm 80 of the bellcrank 74 does not engage the first arm 104 of the bellcrank 100 to avoid pivoting the bellcrank 100 when feeding the print ribbon 48.

Figure 4:
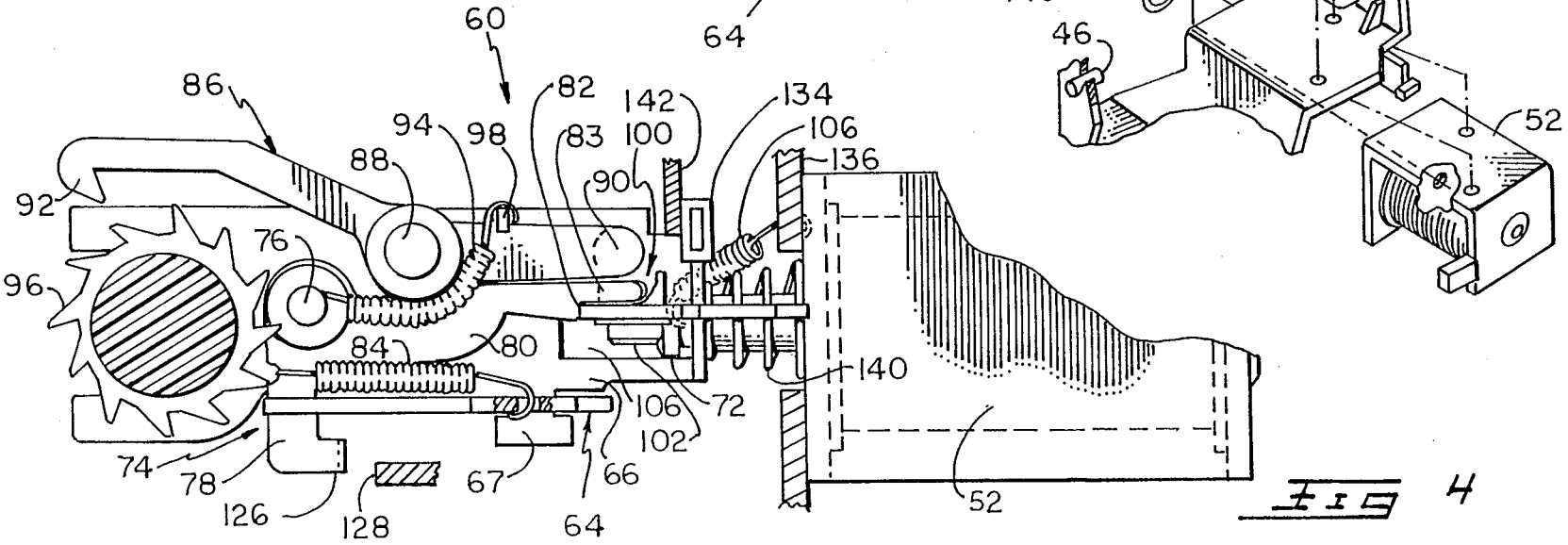
FIG. 4 is a partial top plan view of FIG. 3.

During a last portion of the movement of the plate 66 and the bellcrank 74 to the right, an abutment 126 integrally formed from the first arm 78 of the bellcrank 74 contacts an abutment 128 (FIG. 4) integrally formed from the carrier 16. The abutment 128 pivots the bellcrank 74 clockwise about the post 76 to restore the bellcrank 74 to its initial position (FIG. 4). When the bellcrank 74 is pivoted clockwise to its initial position by the abutment 128, the second arm 80 rocks the first arm 104 of the bellcrank 100 in a direction perpendicular to the pivot direction of the bellcrank 100. The rocking movement of the first arm 104 prevents the first arm 104 from interferring with the bellcrank 74 pivoting clockwise for returning to its initial position. As shown best in FIG. 7, the spring 84 pivots the latch 64 counterclockwise about the tab 67 until the free end 77 of the second finger 71 abuts against the first arm 78 of the bellcrank 74. The spring 84 also pivots the bellcrank 74 counterclockwise about the post 76 to bias the first arm 78 against the abutment 70 of the second finger 71. When the bellcrank 74 is pivoted clockwise to return to its initial position, the second arm 80 is pivoted away from the abutment 90 of the feed pawl 86. The spring 94 then biases the feed pawl 86 clockwise about the post 88 to disengage the tooth 92 from the toothed ratchet 96. The movement of the plate 66 to the right is limited by an abutment 134 on the plate 66 abutting against a first stop 136 integrally formed from the carrier 16.

After a character has been printed, the print hammer solenoid 26 and the ribbon feed solenoid 52 are de-energized by the electronic circuit 56. When the ribbon feed solenoid 52 is de-energized, a coil spring 140 mounted on the plunger 72 between the ribbon feed solenoid 52 and the plate 66 biases the plate 66 leftward to its initial position (FIG. 4) determined by the abutment 134 contacting a second stop 142 integrally formed from the carrier 16.

FEEDING THE ERROR CORRECTION TAPE

Figure 7:
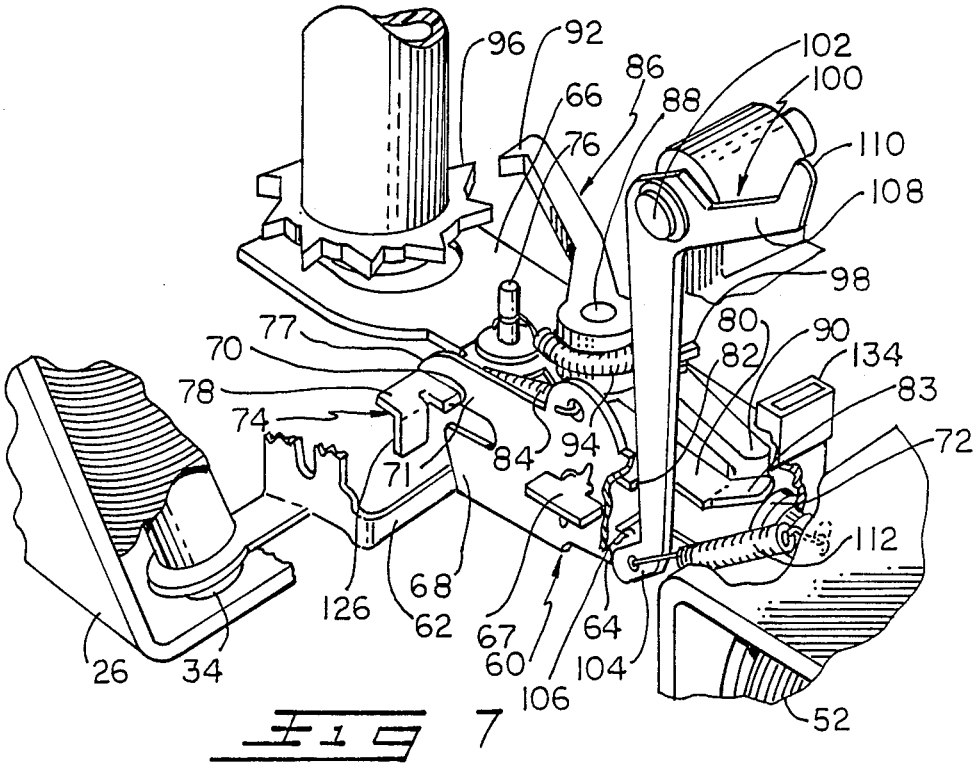
FIG. 7 is a perspective view similar to FIG. 6 showing the ribbon feed mechanism in condition to feed the error correction tape.

When the correction key 20 is depressed, the circuit means 57 is operable to energize the print hammer solenoid 26 after energizing the ribbon feed solenoid 52. A lapse of time before energizing the print hammer solenoid 26 is sufficient to allow the plunger 72 to travel substantially its full stroke to the right. Referring to FIG. 7, the plunger 72 drives the plate 66 to the right. The latch 64 being mounted on the plate 66 moves to the right a sufficient distance to be out of the path of movement of the actuator 62. When the print hammer solenoid 26 is energized, the actuator 62 on the plunger 34 does not contact the first finger 68 of the latch 64. Therefore, the ribbon feed mechanism 60 is maintained in its initial condition for lifting and feeding the error correction tape 36.

The latch 64 holds the bellcrank 74 in its initial position (FIG. 4) as the plate 66 moves to the right. The abutment 82 on the second arm 80 of the bellcrank 74 contacts the first arm 104 of the bellcrank 100 and pivots the bellcrank 100 counterclockwise about the pin 102. The movement of the abutment 110 on the second arm 108 of the bellcrank 100 pivots the platform 38 clockwise about the pivot pins 44 and 46 (FIG. 2). The spring 112 biasing the bellcrank 100 counterclockwise is only lightly tensioned and is not able to pivot the platform 38 clockwise. The platform 38 lifts the supply spool 49, the take-up spool 42 and the error correction tape 36 upward to position the error correction tape 36 in alignment with the print position. The platform 38 lifts the ribbon cartridge 50 and the print ribbon 48 above the print position. After a printed character has been erased, the print hammer solenoid 26 and the ribbon feed solenoid 52 are de-energized by the electronic circuit 56. When the ribbon feed solenoid 52 is de-energized, the coil spring 140 biases the plate 66 to the left limited position against the second stop 142. The plate 66 moves the bellcrank 74 leftward. The abutment 110 of the second arm 108 pivots downward. A spring 144 is connected to the platform 38 and to the carrier 16. The platform 38 is pivoted counterclockwise about the posts 44 and 46 to its initial position by this spring 144 to return the error correction tape 36 below the print position.

The feed mechanism 114 feeds the error correction tape 36 one increment by the movement of the platform 38 returning to its initial position from the raised print position. The fork 122 straddling the post 124 on the carrier 116 pivots the feed pawl 118 about the post 120 on the platform 38 by the return movement of the platform 38. The pivoting of the feed pawl 118 rotates the toothed ratchet 116 to feed the error correction tape 36 one increment.

SUMMARY

It can now be seen that the ribbon feed solenoid 52 is connected to the ribbon feed mechanism 60 either to feed the print ribbon 48 or to lift and feed the error correction tape 36. Also, it can now be seen that the print hammer solenoid 26 conditions the ribbon feed mechanism 60 either for feeding the print ribbon 48 or lifting and feeding the error correction tape 36.

When the print hammer solenoid 26 is energized before the ribbon feed solenoid 52, the actuator 62 being carried by the plunger 34 of the print hammer solenoid 26 pivots the latch 64. The latch 64 causes the feed pawl 82 to engage the toothed ratchet 96 thereby conditioning the ribbon feed mechanism 60 for feeding the print ribbon 48.

When the print hammer solenoid 34 is energized after the ribbon feed solenoid 52, the latch 64 is moved away from the actuator 62 of the print hammer solenoid 26. When the latch 64 is not pivoted, the ribbon feed mechanism 60 is maintained in condition for lifting and feeding the error correction tape 36.

What is claimed is:

1. A ribbon feed system for typewriters having a keyboard with character keys and a correction key, an error correction tape, a print ribbon, a print hammer solenoid, and a ribbon feed solenoid, the ribbon feed system comprising:

feed means connected to the ribbon feed solenoid for feeding the print ribbon and for feeding the error correction tape;

means operably connecting the print hammer solenoid to the feed means; and means including an electronic circuit responsive to depression of any of the character keys, thereby energizing the print hammer solenoid, for conditioning the feed means to feed the print ribbon and for thereafter energizing the ribbon feed solenoid to feed the print ribbon.

2. The ribbon feed system of claim 1 wherein the feed means includes a latch and wherein the means operably connecting the print hammer solenoid to the feed means is an actuator for moving the latch in response to energizing the print hammer solenoid to condition the feed means for feeding the print ribbon.

3. The ribbon feed system of claim 1 wherein the electronic circuit responsive to depression of the correction key energizes the ribbon feed solenoid for feeding the error correction tape.

4. The ribbon system of claim 2 wherein the feed means includes a bellcrank operable in a first position for feeding the error correction tape in response to energizing the ribbon feed solenoid, and the bellcrank is released by the latch in response to energizing the print hammer solenoid for movement to a second position to condition the feed means for feeding the print ribbon.

5. The ribbon feed system of claim 4 wherein the feed means includes a ratchet operably connected to the print ribbon, a plate connected to the ribbon feed solenoid, a feed pawl mounted on the plate, the bellcrank engages the feed pawl with the ratchet when the bellcrank moves from the first position to the second position, the plate causes the feed pawl to rotate the ratchet for feeding the print ribbon in response to energizing the ribbon feed solenoid.

6. The ribbon feed system of claim 4 wherein the feed means includes a lever, a plate connected to the ribbon feed solenoid, the bellcrank mounted on the plate, the plate causes the bellcrank when in the first position to move the lever for feeding the error correction tape in response to energizing the ribbon feed solenoid.

7. A method of operating a ribbon feed system for typewriters having a keyboard with character keys and a correction key, an error correction tape, a print ribbon, a print hammer solenoid, a ribbon feed solenoid, a ribbon feed mechanism for feeding the print ribbon and the error correction tape, an electronic circuit operable to energize the print hammer solenoid and the ribbon feed solenoid, the method comprising the steps of:

energizing the print hammer solenoid in response to depression of a character key for conditioning the ribbon feed mechanism for feeding the print ribbon; and thereafter energizing the ribbon feed solenoid in response to the depression of the character key for feeding the print ribbon.

8. The method of claim 7 further comprising the step of energizing the ribbon feed solenoid in response to depression of the correction key for feeding the error correction tape.

* * * * *